United States Patent [19]

Gongwer

[11] Patent Number: 5,072,579

[45] Date of Patent: Dec. 17, 1991

[54] MARINE VESSEL THRUSTER

[75] Inventor: Calvin A. Gongwer, Glendora, Calif.

[73] Assignee: Innerspace Corporation, Covina, Calif.

[21] Appl. No.: 511,414

[22] Filed: Apr. 20, 1990

[51] Int. Cl.[5] ..... B63H 1/14

[52] U.S. Cl. ..... 60/221; 114/151

[58] Field of Search ..... 60/221, 222; 114/151; 440/38, 40; 440/38, 40

[56] References Cited

U.S. PATENT DOCUMENTS

| | | | |
|---|---|---|---|
| 1,484,881 | 2/1924 | Gill . | |
| 3,590,766 | 7/1971 | Jackson . | |
| 3,809,005 | 5/1974 | Rodler, Jr. | 60/221 |
| 3,835,806 | 9/1974 | Rice | 60/222 |
| 4,073,257 | 2/1978 | Rodler, Jr. | 60/221 |
| 4,278,431 | 7/1981 | Krautkremer et al. . | |

FOREIGN PATENT DOCUMENTS

| | | | |
|---|---|---|---|
| 1817080 | 7/1970 | Fed. Rep. of Germany | 114/151 |

*Primary Examiner*—Louis J. Casaregola
*Assistant Examiner*—Lalek Jalali
*Attorney, Agent, or Firm*—Lyon & Lyon

[57] ABSTRACT

A ductless wall thruster for a marine vessel has a housing with a plenum chamber therein and, at a forward end of the housing, at least one inlet opening surrounding an outlet opening. An impeller is rotatably mounted within the housing so that when the impeller is rotated, it draws water into the housing and discharges it through the outlet opening to create a thrust. Preferably, there is a plurality of equally dimensioned inlet openings defined by stationary vanes inclined in a direction opposite the normal direction of rotation of the impeller. The outlet opening is preferably defined on a forward end of a central impeller housing in which the impeller is mounted, with the impeller having a flow area therethrough which is greater than the flow are through the outlet opening.

20 Claims, 1 Drawing Sheet

FIG. 1.
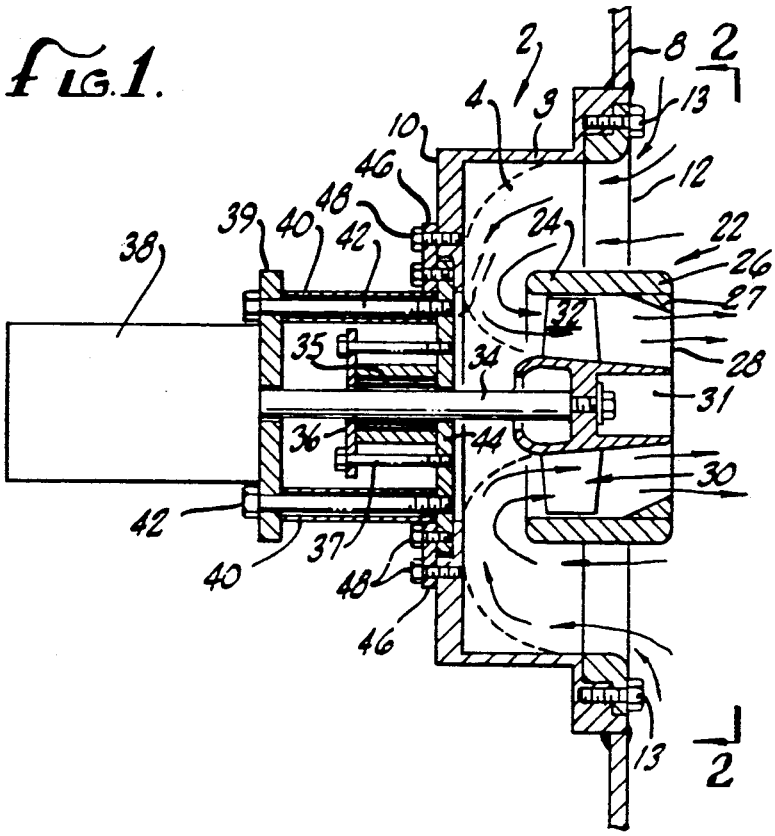
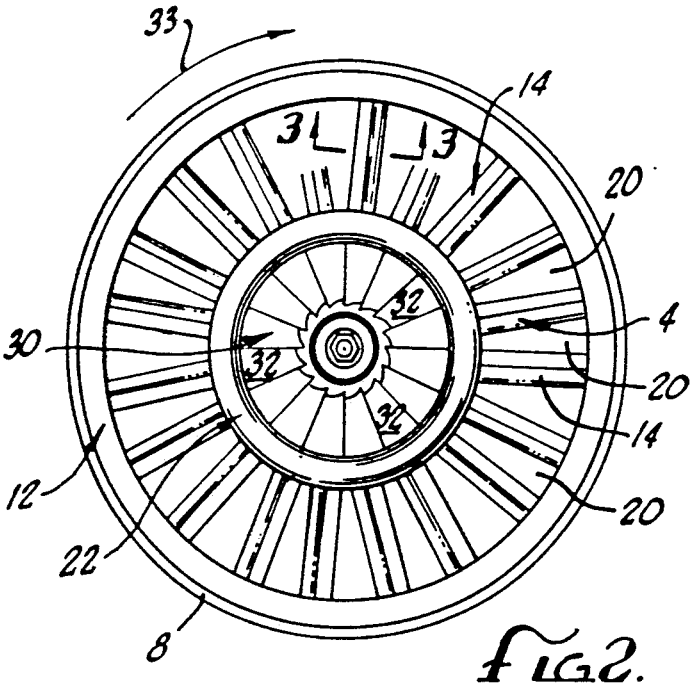
FIG. 2.
FIG. 3.
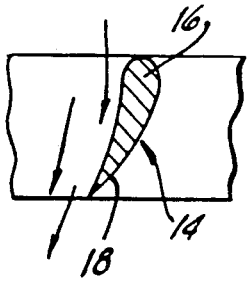

side wall 3, a circular rear wall 10 (with a central circular opening 11 therein) at a rearward end of housing 2, and a circular cover 12 held by bolts 13 on a forward end of housing 2. Cover 12 is divided by a series of symmetrically disposed stationary vanes, into a plurality of adjacent, equal sized, inlet openings 20. Each of stationary vanes 14 is inclined from a forward edge 16 to a rearward edge 18, as best seen in FIG. 3, and extends from side wall 3 to a central circular stationary impeller housing 22 of housing 2. Impeller housing 22 is generally cylindrical except a forward end 26 tapers inwardly toward an outlet opening 28, as best seen in FIG. 1. The tapering is accomplished by mounting a circular ring 27, with an inner surface sloping inward and forward, to the forward end of the remainder of housing 22 by means of screws (not shown). An impeller 30, having a plurality of vanes 32, is mounted within impeller housing 22 rearward of forward end 26 thereof, for rotation in the direction of arrow 33 in FIG. 2. It will be noted that direction 33 is opposite the direction of inclination of stationary vanes 14 of impeller housing 12. Impeller 30 has a flow area therethrough which is greater than the flow area through outlet opening 28. Both of the foregoing areas are annuli. Specifically, the flow through area of impeller 30 is approximately the total cross-sectional area of impeller 30 at vanes 32, minus the cross-sectional area of a central member 31 at the same position (i.e. approximately the cross-sectional area of vanes 32). The flow through area of outlet opening 28 approximately the total cross-sectional area of outlet opening 28 minus the cross-sectional area of central member 31 at the position of outlet opening 28.

Impeller 30 is rotatably driven by a drive shaft 34 extending from central member 31 of impeller 30, through rear wall 10 of housing and a drive shaft seal 35 (secured in place to rear wall 10 by plate 36 and associated bolts 37) to a hydraulic drive motor 38. Hydraulic motor 38 is mounted on rear wall 10 by means of bolts 42 extending through spacers 40 into a back plate 44 held in sealing engagement over opening 11 by means of bolts 48 and associated ring 46.

Prior to use of the described thruster, it is first mounted on the side of the hull of a vessel preferably by welding housing 2 to the hull 8 so that impeller is facing outward and sideways of the hull, as best seen in FIG. 1. No ducting or other modifications to the hull are required. Hydraulic motor 38 is connected to a suitable source of hydraulic fluid through a valve (both not shown). When pressurized hydraulic fluid is directed through motor 38, impeller 30 will rotate in the direction of arrow 33 (see FIG. 2). Water will then be drawn into plenum chamber 4 through inlet openings 20, with stationary vanes 14 imparting a rotational swirl, opposite the direction of arrow 33, to incoming water by virtue of the inclination of vanes 14. It will be noted that vanes 14 will act as an inlet screen to inhibit debris from entering plenum chamber 4. Impeller 30 then discharges water from plenum chamber 4 outward through outlet opening 28, and tends to provide the discharged water with a rotational swirl in the direction of arrow 33. It is expected that the foregoing rotational swirl is at least partially cancelled by the oppositely rotating swirl imparted to the water in plenum chamber 4 by vanes 14, as already described. Thus, the amount of energy which otherwise might be wasted in a rotating swirl in the discharged water, is expected to be reduced. As a result of impeller 30 having a greater flow area therethrough than outlet 28, the possibility of cavitation during operation of impeller 30 at high speeds is greatly reduced.

It will be seen that during operation of the thruster, water exiting through outlet 28 has minimal contact with water entering inlet openings 20. Thus, thrust is not significantly reduced as a result of any such contact. It will also be appreciated that the described thruster is unidirectional, impeller 30 being intended to rotate only in the direction of arrow 33. Also, the swirl induced into the water entering plenum chamber 4 is expected to assist the water in passing around the U-shaped bend into impeller housing 12. Conservation of angular momentum would be expected to increase the speed of rotation of the swirl as it moves from inlet openings 20 to impeller housing 12, since the swirl is being forced closer to the axis about which it rotates (i.e. drive shaft 34). The fact that the overall cross-sectional area decreases moving from inlet openings 20 to impeller housing 12, would tend to suppress flow separation.

Should it be desired to service the foregoing described thruster after it has been installed in a boat hull, a diver may first simply cover the outboard end of the thruster such that water cannot enter plenum chamber 4. Then, removal of bolts 48 and associated ring 46 from inside the hull, will allow the entire motor 38 and impeller 30 assembly (including plates 39, 44, and seal 35 and associated bolts) to be withdrawn into the hull (impeller 30 passing through opening 11 in rear wall 10 of housing 2). In addition, it will be seen that the arrangement shown provides easy access for maintenance or replacement of seal 35.

Modifications to the above described thruster are, of course, possible. For example, hydraulic motor 38 might be replaced with another drive motor if desired, although a hydraulic motor is preferred. Also front plate 39 of motor 38 could be mounted directly adjacent rear wall 10. However, the stand off arrangement shown in FIG. 1 allows easy access for maintenance or replacement of shaft seal 35, as already mentioned. As well, stationary vanes 14 could be sloped in the opposite direction (i.e. in the same direction as the impeller vanes 32), so as to tend to create a swirl in water entering plenum chamber 4, which swirl would be in the same direction as arrow 33. Such an arrangement is expected to lead to improved resistance to cavitation although the thruster may not produce the same amount of thrust for a given input energy as when the stationary vanes 14 are sloped in the manner shown in the drawings. Another modification is the provision of plenum chamber 4 with smooth (i.e. no corner) surfaces, in the manner shown in broken lines in FIG. 1. Such an arrangement is expected to reduce friction with water flowing through chamber 4.

Other modifications and alterations of the present invention are further possible. Accordingly, the present invention is not limited to those embodiments specifically described above.

I claim:

1. A wall thruster for a marine vessel comprising:

(a) a housing having a substantially cylindrical plenum chamber therein and a circular cover at a forward end thereof, the cover having a plurality of inlet openings surrounding a central outlet opening wherein the outlet opening is circular; and (b) an impeller disposed within the housing such that the impeller, when rotated, can draw water into the plenum chamber through the inlet openings and discharge it out through the outlet opening to cre-

MARINE VESSEL THRUSTER

FIELD OF THE INVENTION

The present invention relates to a thruster for a marine vessel which does not require ducting through the vessel's hull.

TECHNOLOGY REVIEW

The prior art includes my U.S. Pat. No. 4,055,947, "Hydraulic Thruster," granted Nov. 1, 1977, my U.S. Pat. Nos. 4,137,709 and 4,213,736, both entitled "Turbomachinery and Method of Operation," granted Feb. 6, 1979, and July 22, 1980, respectively, and my U.S. Pat. No. 4,672,807 entitled "Wall Thruster and Method of Operation." The basic design relationship for turbomachinery is defined by the Euler turbine equation, a form of Newton's laws of motion applied to fluid traversing a rotor. See, generally, Shepard, "Principles of Turbomachinery, Energy Transfer Between a Fluid and a Rotor" (MacMillan Co. 1965). The foregoing patents and text are all incorporated herein by reference.

Most of the marine thrusters presently used on ships and barges require internal ducting through the bow of the ship. These hull ducts are expensive, inconvenient, and inefficient. One of the drawbacks with these ducts is that large ports must be made on the side of the ship for the thruster to operate properly. These large ports create tremendous drag as the ship travels through the water. The extra drag is currently a concern among shipbuilders and users as a result cf the high cost of fuels.

The propellers currently used in the ducted thrusters are generally birotational and are prone to cavitation when driven at high thrust levels. The cavitation, besides creating a noise nuisance, is damaging to parts and limits the maximum thrust level, resulting in inefficient operation. Further, as these thrusters are bidirectional, screening is desirable on the intake/outflow ports. The fixed screens on the ports further reduce the maximum thrust.

As the use of the ducted thrusters requires a duct from one side of the hull to the other, certain vessels are unable to employ these thrusters. On some vessels, it is either too expensive to install the lengthy duct necessary, or the length of the duct will require too large a thrust to overcome frictional losses and still achieve adequate thrust. Further, on barges and cargo carriers, the duct takes up precious space that would otherwise be used for cargo.

The design of my ductless, unidirectional wall thruster in U.S. Pat. No. 4,672,807 overcomes many of the shortcomings of previous thrusters. However, that wall thruster exhibited some loss of thrust due to mixing of inlet and outlet water.

SUMMARY OF THE INVENTION

Prior to describing the present invention, it should be noted that words such as "forward," "rearward," etc., in reference to the thruster of the present invention, indicate the relative orientation of the parts of the thruster and not the orientation in relation to a vessel in which it is installed. When the thruster of the present invention is installed in the side of a hull of a vessel, the "forward" end will be the outboard end and is directed sideways with respect to the vessel.

The present invention, then, provides a discharge thruster for a marine vessel which is typically installed in the side of the hull of a vessel to provide a sideways thrust. The thruster of the present invention does not require ducting through the vessel's hull. Such wall thruster has a housing with a plenum chamber. A forward end of the housing has at least one inlet opening, and preferably a plurality of equal sized inlet openings, surrounding a central outlet opening. An impeller is positioned within the housing so that, when rotated, the impeller draws water into the plenum chamber through the inlet opening(s) and discharges it through the outlet opening to create a thrust.

In a particular construction of the thruster of the present invention, the outlet opening is preferably circular and is the forward end of a circular impeller housing. Such impeller housing extends from a position forward of a rear wall of the plenum chamber to a position which is preferably forward of the inlet opening(s). An impeller is disposed within the housing, preferably intermediate the ends of the impeller housing, such that when the impeller is rotated it can draw water through the inlet opening(s) into the plenum, and discharge it through the outlet opening to create a thrust. Preferably, the flow area through the outlet opening is smaller than the flow area through the impeller. This is accomplished by providing the forward end (i.e. the outlet opening) of the impeller housing, which is otherwise generally cylindrical in shape, with a restriction. In addition, the inlet openings may be positioned symmetrically about the outlet opening and are separated by respective stationary vanes which are inclined, from their forward to rearward edges, in a direction opposite that which the impeller normally rotates (the direction of "normal rotation" being that direction which causes water to be discharged through the outlet opening to create thrust).

The thruster of the present invention exhibits many of the advantages of the thruster described in my U.S. Pat. No. 4,672,807. In particular, in addition to not requiring any ducting through a vessel's hull, since the impeller is unidireotional (rotates in one direction only), it does not require any screens on the discharge opening. Thus, thrust loss from such screens is eliminated. In addition to the foregoing advantages though, the central positioning of the outlet opening and surrounding inlet openings reduces mixing of water between the inlet and outlet openings with consequent loss of thrust. That is, water entering the inlet openings does not come into contact with the water being discharged from the outlet opening to the same extent as may occur in the thruster described in my U.S. Pat. No. 4,672,807.

DRAWINGS

Embodiments of the invention will now be described with reference to the following drawings, in which:

FIG. 1 is a cross-section of a thruster of the present invention; and

FIG. 2 is a front elevation of the thruster of FIG. 1 viewed along the line 2—2 of FIG. 1; and FIG. 3 is a cross-section along line 3—3 on FIG. 2.

DETAILED DESCRIPTION OF EMBODIMENTS OF THE INVENTION

Referring to FIGS. 1-3, the wall thruster of the present invention shown comprises a housing 2 which defines a substantially cylindrical plenum chamber 4 within housing 2. Housing 2 has a generally cylindrical ate a thrust wherein the flow area through the impeller is greater than the flow area through the outlet opening so as to reduce cavitation during operation of the thruster.

2. A wall thruster a defined in claim 1 wherein the cover has a circular impeller housing within which the impeller is disposed, the impeller housing extending from a rearward end forward of a rear wall of the plenum chamber, to a forward end wherein the diameter of the forward end of the impeller housing has a diameter reduced in dimension from the diameter of the impeller, the forward end defining the outlet opening of a diameter less than the diameter of the impeller.

3. A wall thruster as defined in claim 2 wherein the impeller housing is substantially cylindrical with a reduced diameter portion at the forward end thereof.

4. A wall thruster as defined in claim 2 wherein the forward end of the impeller housing is forward of the inlet openings.

5. A wall thruster as defined in any one of claims 1–4 additionally comprising:

a drive shaft connected to and extending rearward from the impeller and through the rear wall of the plenum chamber; and a drive motor connected to the shaft so as to turn to the impeller.

6. A wall thruster for a marine vessel, comprising:

(a) a housing having a substantially cylindrical plenum chamber therein and a circular cover at a forward end thereof, the cover having:

a plurality of adjacent equal sized inlet openings symmetrically surrounding a central circular outlet opening, the inlet openings being equally spaced and separated by respective stationary vanes each having a forward edge and a rearward edge which are formed such that water entering the inlet openings is induced to rotate;

a central circular impeller housing extending from a rearward end forward of a rear wall of the plenum chamber, to a forward end defining the outlet opening;

(b) an impeller disposed within the housing such that the impeller, when rotated in a direction opposite the inclination of the stationary vanes of the impeller housing, can draw water into the plenum chamber through the inlet openings and discharge it through the outlet opening to create a thrust said impeller having a flow area therethrough greater than the flow area through the outlet opening.

7. A wall thruster as defined in claim 6 wherein the impeller housing is substantially cylindrical with a reduced diameter portion at the forward end thereof.

8. A wall thruster as defined in claim 6 wherein the forward end of the impeller housing is forward the inlet openings.

9. A wall thruster as defined in claim 6 or 8 additionally comprising:

a drive shaft connected to and extending rearward from the impeller and through a rearward end of the housing; and a drive motor connected to the shaft so as to turn the impeller.

10. A marine vessel having mounted on a side of its hull, a wall thruster as defined in any one of claims 1 to 4 and 6 to 8, with the forward end of the thruster in contact with the water, the wall thruster additionally comprising;

a drive shaft connected to and extending rearward from the impeller and through a rearward end of the housing; and a drive motor connected to the shaft so as to turn to the impeller;

such that rotation of the drive motor produces a thrust perpendicular to the longitudinal axis of the vessel.

11. A marine thruster, comprising a housing having side walls and a forward end and a rearward end with a plenum chamber defined therein and having an inlet opening and an outlet opening wherein both said inlet opening and said outlet opening is disposed at the forward end of said housing;

an impeller housing having an impeller disposed therein;

said outlet opening being aligned substantially with the center of the housing and said inlet opening surrounding said outlet opening;

said impeller being aligned substantially with the center of said outlet opening such that when said impeller is rotated water is drawn into said plenum chamber through said inlet opening in a rearward direction and discharged through said outlet opening in a forward direction.

12. A thruster as defined in claim 11 comprising a plurality of inlet openings surrounding said outlet opening.

13. A thruster as defined in claim 11 wherein said impeller housing is cylindrical in configuration.

14. A thruster as defined in claim 13 wherein said impeller housing has a rearward end through which water is drawn from said plenum into said impeller housing when said impeller is rotated and a forward end forming said outlet opening wherein the diameter of said rearward end is larger than the diameter of said forward end.

15. A thruster as defined in either of claims 11 or 14 wherein said inlet opening has an annular configuration.

16. A thruster as defined in any of claims 11 through 13 wherein said outlet opening is circular in form.

17. A thruster as defined in claim 12 wherein said plurality of inlet openings are formed by a plurality of stationary vanes equally spaced around said outlet opening.

18. A thruster as defined in claim 17 wherein the cross sectional shape of said stationary vanes is that of a hydrofoil.

19. A thruster as defined in either of claim 17 or 18 wherein the stationary vanes are positioned in a manner that when said impeller draws water into said plenum chamber through said inlet openings a rotational motion is imparted to the incoming water as it enters said plenum chamber.

20. A thruster as defined in claim 19 wherein the rotational motion imparted to the incoming water is in the same direction as the rotation of said impeller.

* * * * *